US010060207B2

(12) United States Patent
Shotton et al.

(10) Patent No.: US 10,060,207 B2
(45) Date of Patent: Aug. 28, 2018

(54) RISER SYSTEM AND METHOD OF USE

(71) Applicant: HELIX ENERGY SOLUTIONS GROUP, INC., Houston, TX (US)

(72) Inventors: Paul Shotton, Aberdeen (GB); John Edward Wood, Aberdeen (GB)

(73) Assignee: Helix Energy Solutions Group, Inc., Houston, TX (US)

( * ) Notice: Subject to any disclaimer, the term of this patent is extended or adjusted under 35 U.S.C. 154(b) by 97 days.

(21) Appl. No.: 13/644,543

(22) Filed: Oct. 4, 2012

(65) Prior Publication Data

US 2013/0087342 A1 Apr. 11, 2013

Related U.S. Application Data

(60) Provisional application No. 61/543,657, filed on Oct. 5, 2011.

(51) Int. Cl.

| | |
|---|---|
| ***E21B 17/01*** | (2006.01) |
| ***E21B 21/08*** | (2006.01) |
| ***E21B 33/038*** | (2006.01) |
| ***E21B 17/08*** | (2006.01) |
| ***E21B 19/00*** | (2006.01) |

(52) U.S. Cl.

CPC ..... *E21B 21/08* (2013.01); *E21B 17/085* (2013.01); *E21B 19/006* (2013.01); *E21B 33/038* (2013.01)

(58) Field of Classification Search

CPC ..... E21B 17/01; E21B 17/085; E21B 19/004; E21B 19/006

USPC ..... 166/350, 345, 367; 405/224.2–224.4

See application file for complete search history.

(56) References Cited

U.S. PATENT DOCUMENTS

| | | | | |
|---|---|---|---|---|
| 5,533,574 | A * | 7/1996 | Gonzalez | 166/358 |
| 5,609,488 | A | 3/1997 | McTaggart | |
| 5,727,640 | A * | 3/1998 | Gleditsch | 175/7 |
| 5,941,310 | A * | 8/1999 | Cunningham et al. | 166/345 |
| 6,230,824 | B1 | 5/2001 | Peterman | |
| 6,273,193 | B1 * | 8/2001 | Hermann et al. | 166/359 |
| 7,188,677 | B2 * | 3/2007 | Moe | 166/355 |
| 7,658,228 | B2 * | 2/2010 | Moksvold | 166/345 |

(Continued)

FOREIGN PATENT DOCUMENTS

| | | |
|---|---|---|
| GB | 2358032 A | 11/2001 |
| WO | 2011026897 A2 | 10/2011 |

OTHER PUBLICATIONS

PCT Search Report dated Nov. 11, 2013 for PCT Application No. PCT/US2012/058862, pp. 1-4.

*Primary Examiner* — Matthew R Buck
(74) *Attorney, Agent, or Firm* — Locke Lord LLP

(57) ABSTRACT

A riser system and method including a bore submerged surface package of valves, a cross over assembly with a high pressure-low pressure connector connected to the bore submerged surface package of valves, a high pressure insert, and a telescoping flow tube. The riser system also include a high pressure bore subsea stack, a low pressure slip joint, a tension ring, a flex joint, a diverter, a mandrel capable of interfacing with the high pressure-low pressure connector, a high pressure mandrel crossover and at least one high pressure insert riser joint, a high pressure-low pressure latch, a telescoping flow tube telescopic conduit, at least one telescoping flow tube latch, a telescoping flow tube low pressure flex joint, a telescoping flow tube main housing, or a rotating control device.

14 Claims, 5 Drawing Sheets

(56) References Cited

U.S. PATENT DOCUMENTS

| | | | | |
|---|---|---|---|---|
| 7,699,109 | B2 * | 4/2010 | May et al. | 166/367 |
| 2005/0061546 | A1 * | 3/2005 | Hannegan | 175/7 |
| 2009/0255683 | A1 * | 10/2009 | Mouton et al. | 166/355 |
| 2011/0005767 | A1 * | 1/2011 | Muff et al. | 166/345 |
| 2011/0127040 | A1 * | 6/2011 | Humphreys | 166/345 |
| 2012/0091705 | A1 * | 4/2012 | Reinas et al. | 285/223 |
| 2012/0160508 | A1 * | 6/2012 | Thommesen | 166/355 |
| 2013/0206418 | A1 * | 8/2013 | Pettersen et al. | 166/336 |

* cited by examiner

RISER SYSTEM AND METHOD OF USE

CROSS REFERENCE TO RELATED APPLICATIONS

This nonprovisional application for patent claims priority to, and hereby incorporates by reference, U.S. Provisional Application Ser. No. 61/543,657, entitled "Riser System and Method Utilizing One Or More Inserts," filed Oct. 5, 2011.

BACKGROUND OF THE INVENTION

Technical Field of Invention

The invention disclosed and taught herein relates generally to a system and method of use of a riser system that may be employed to arrest the vertical motion association with heave in floating offshore environments including drilling rigs.

Description of Related Art

Many drilling rigs employ low pressure marine riser systems to compensate for the effects of heave associated with waves, swell, and tides. This has included the use of low pressure systems that include a riser from the sea floor up to the installation. The low pressure systems have included the use of telescoping joints that compensate for the heave associated with these effects.

Other rigs have benefitted from the inclusion of a high pressure riser system. These high pressure systems have included completion and workover risers. These high pressure riser systems have not included telescoping joints because it would require high pressure dynamic seals and acceptance as part of well control equipment.

Therefore, a need exists for combining both low pressure operations and high pressure operations in a riser system that can still provide the reduction or elimination of rig heave during high pressure riser operations and the reduction or elimination of impact of fluid volume changes due to rig heave.

SUMMARY OF THE INVENTION

The present invention includes a riser system that may include a bore submerged surface package of valves ("SSP"), a cross over assembly with high pressure-low pressure ("HP-LP") connector which converts the riser from a high pressure ("HP") bore to a low pressure ("LP") large bore riser, a high pressure insert ("HPI"), and a telescoping flow tube ("TFT").

For high pressure operations, the existing high pressure riser system is rigged up with the low pressure telescoping joint connecting the high pressure riser system to the vessel. The vessel is now connected to the subsea tree. The vessel motions are restricted as a function of dynamic positioning, however the vessel still experiences heave motions. The heave motions are absorbed by the low pressure telescoping joint but effectively the riser length, and therefore volume, is constantly changing as a result of vessel motion. For high pressure well operations the high pressure insert is rigged up and landed out within the base of the telescoping joint. The upper end of the high pressure insert is connected to the derrick via the surface equipment. The derrick provides motion compensation such that there is now no motion absorption by the riser, even though the telescoping joint continues to absorb heave motion. High pressure well intervention operations can now commence.

For low pressure operations, the existing high pressure riser system is rigged up with the low pressure telescoping joint connecting the high pressure riser system to the vessel. The vessel is now connected to the subsea tree. The vessel motions are restricted as a function of dynamic positioning, however the vessel still experiences heave motions. The heave motions are absorbed by the low pressure telescoping joint but effectively the riser length, and therefore volume, is constantly changing as a result of vessel motion. The telescoping flow tube is inserted and landed out within the base of the telescoping joint. The telescoping flow tube is landed out at the drill floor level and is now compensating in parallel with the vessel. The volume change as a function of the telescoping flow tube is facilitated by holes within the cavity and so no volume change occurs as a result of vessel motion. Constant volume is key for well control in these relatively slimhole drilling operations. The reduced bore afforded by the telescoping flow tube promotes cuttings velocity and maintains well cleanout.

In general, the disclosed embodiments are directed to a riser system including a bore submerged surface package of valves, a cross over assembly with a high pressure-low pressure connector connected to the bore submerged surface package of valves, a high pressure insert, and a telescoping flow tube. This embodiment may also include a high pressure bore subsea stack. The high pressure bore subsea stack may be connected to a high pressure bore open water riser joint, wherein the high pressure bore open water riser joint is connected to the bore submerged surface package of valves. This embodiment may also include a low pressure slip joint, a tension ring, a flex joint, a diverter, a mandrel capable of interfacing with the high pressure-low pressure connector, a high pressure mandrel crossover and at least one high pressure insert riser joint. The mandrel may include at least one seal or elastomeric seal. The riser system may also include a high pressure-low pressure latch, a low pressure telescoping joint, wherein the telescoping flow tube is installed the low pressure slip joint, a telescopic conduit, at least one telescoping flow tube latch, a telescoping flow tube low pressure flex joint, a telescoping flow tube main housing, and/or a rotating control device.

Another embodiment of the invention may include a method of installing and using a riser system that includes connecting a bore submerged surface package of valves to a cross over assembly with a high pressure-low pressure connector, connecting a high pressure insert, connecting a telescoping flow tube, and/or connecting a mandrel to the high pressure insert.

DESCRIPTION OF THE DRAWINGS

The foregoing and other aspects of the disclosed embodiments will become apparent from the following detailed description and upon reference to the drawings, wherein.

DESCRIPTION OF DISCLOSED EMBODIMENTS

The drawings described above and the written description of specific structures and functions below are presented for illustrative purposes and not to limit the scope of what has been invented or the scope of the appended claims. Nor are the drawings drawn to any particular scale or fabrication standards, or intended to serve as blueprints, manufacturing parts list, or the like. Rather, the drawings and written description are provided to teach any person skilled in the art to make and use the inventions for which patent protection is sought. Those skilled in the art will appreciate that not all features of a commercial embodiment of the inventions are described or shown for the sake of clarity and understanding.

Persons of skill in this art will also appreciate that the development of an actual, real-world commercial embodiment incorporating aspects of the inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would nevertheless be a routine undertaking for those of skill in this art having the benefit of this disclosure.

It should also be understood that the embodiments disclosed and taught herein are susceptible to numerous and various modifications and alternative forms. Thus, the use of a singular term, such as, but not limited to, "a" and the like, is not intended as limiting of the number of items. Similarly, any relational terms, such as, but not limited to, "top," "bottom," "left," "right," "upper," "lower," "down," "up," "side," and the like, used in the written description are for clarity in specific reference to the drawings and are not intended to limit the scope of the invention or the appended claims.

Figure 1:
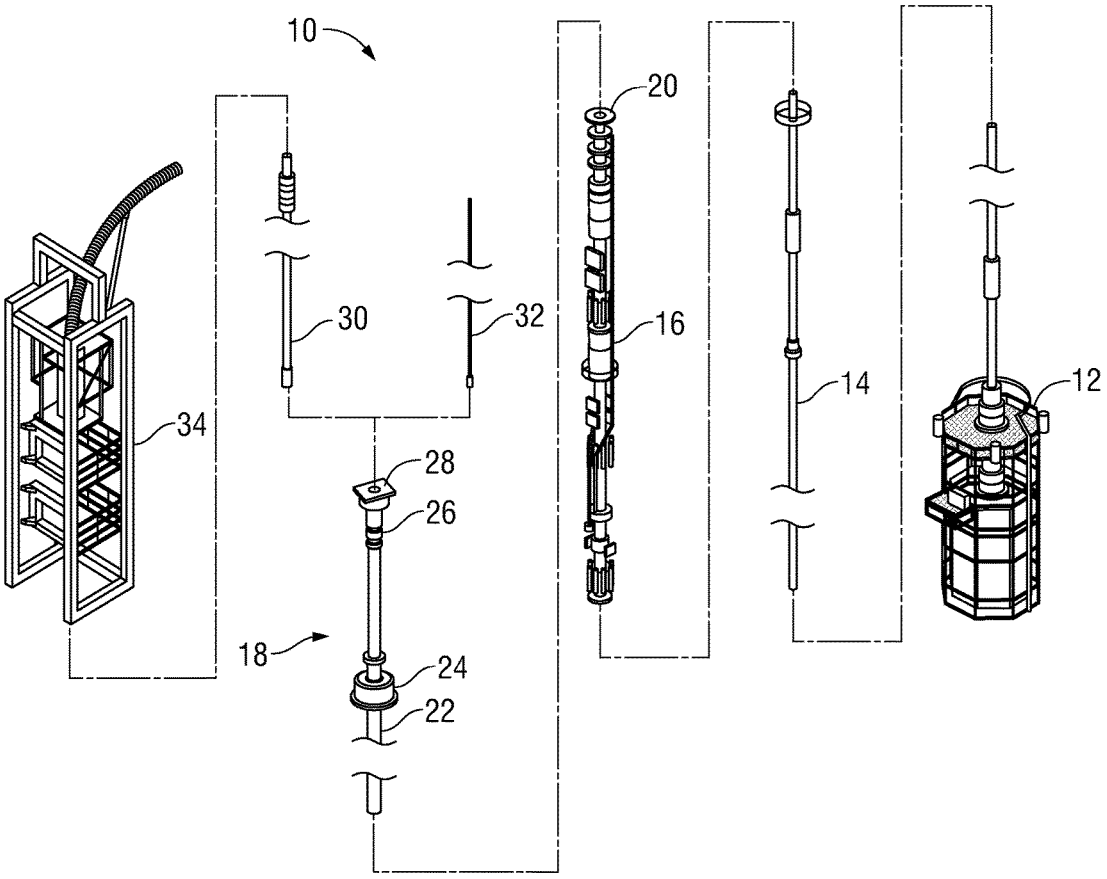
FIG. 1 is an exploded view of an embodiment of the riser system.

FIG. 1 shows a preferred embodiment of the invention. The preferred embodiment relates to a semisubmersible rig and riser that may be used in wire line ("WL")/coiled tubing ("CT") intervention and Through Tubing Rotary Drilling ("TTRD") on existing, completed wells.

As shown from the bottom up, the system 10 may include a high pressure ("HP") bore subsea stack 12, such as a 10k, 7" bore subsea stack. The bore subsea stack 12 is connected to HP bore open water riser joints 14, such as HP 10*k*, 7" bore open water riser joints. The HP bore open water riser joints 14 are connected to HP bore submerged package of valves ("SSP") 16, such as a HP 10*k*, 7" bore submerged SSP. The HP bore SSP 16 is connected to a crossover assembly 18. The cross over assembly 18 includes high pressure-low pressure ("HP-LP") connectors 20 which are capable of converting the system 10 from a high pressure to a low pressure bore, such as a HP 10*k*, 7" bore to a low pressure, large bore riser such as a 21" bore. In a preferred embodiment, this assembly 18 is located at the top of the SSP 16 and is approximately 25 m below the rig floor. Connected to the cross over assembly 18, the system 10 may also have a conventional large bore drilling riser configuration consisting of LP slip joint 22 and a tension ring 24, a flex joint 26, and a diverter 28 for hang off from the rig floor.

With the present invention, the system 10 may have a rig heave motion relative to the well is compensated for in the manner of a conventional drilling rig by extension/contraction of the LP slip joint 22 at the top of the riser string.

The present invention relates to at least two insert assemblies. First, the system 10 may include a high pressure insert ("HPI") 30 which is employed during intervention operations. Second, the system 10 may include a telescoping flow tube ("TFT") 32, which may be employed during TTRD operations. Both the HPI 30 and the TFT 32 assemblies are lowered from the rig floor into the LP slip joint 22 and their bottom ends engage with the HP-LP connector 20 at the top of the SSP 16. The upper end of the HPI 30 engages with a WL or CT stack mounted in a frame 34 hung off and compensating on the rig tower draw works. The upper end of the TFT 32 land off inside the diverter 28 below the rig floor level.

The HPI 30 may be installed down through into the low pressure slip joint 22. It connects to the HP-LP connector 20 at the top of the SSP 16. In a preferred embodiment, the HPI 34 is installed through the low pressure slip joint 26 such that a 7" bore HP conduit is above the drill floor. The top of the HPI 30 connects through a stack in the appropriate intervention frame 34 (CT or WL). In this preferred embodiment, the frame 34 may be suspended above rig floor on a draw works. Once rigged up and in operations the HPI 30 and frame 34 is a rigid length which is fixed relative to seabed and compensated relative to the rig floor by a draw works compensation system.

As discussed above, for high pressure operations, the existing high pressure riser system is rigged up with the low pressure telescoping joint connecting the high pressure riser system to the vessel. The vessel is now connected to the subsea tree. The vessel motions are restricted as a function of dynamic positioning, however the vessel still experiences heave motions. The heave motions are absorbed by the low pressure telescoping joint but effectively the riser length, and therefore volume, is constantly changing as a result of vessel motion. For high pressure well operations the high pressure insert is rigged up and landed out within the base of the telescoping joint. The upper end of the high pressure insert is connected to the derrick via the surface equipment. The derrick provides motion compensation such that there is now no motion absorption by the riser, even though the telescoping joint continues to absorb heave motion. High pressure well intervention operations can now commence.

Figure 2:
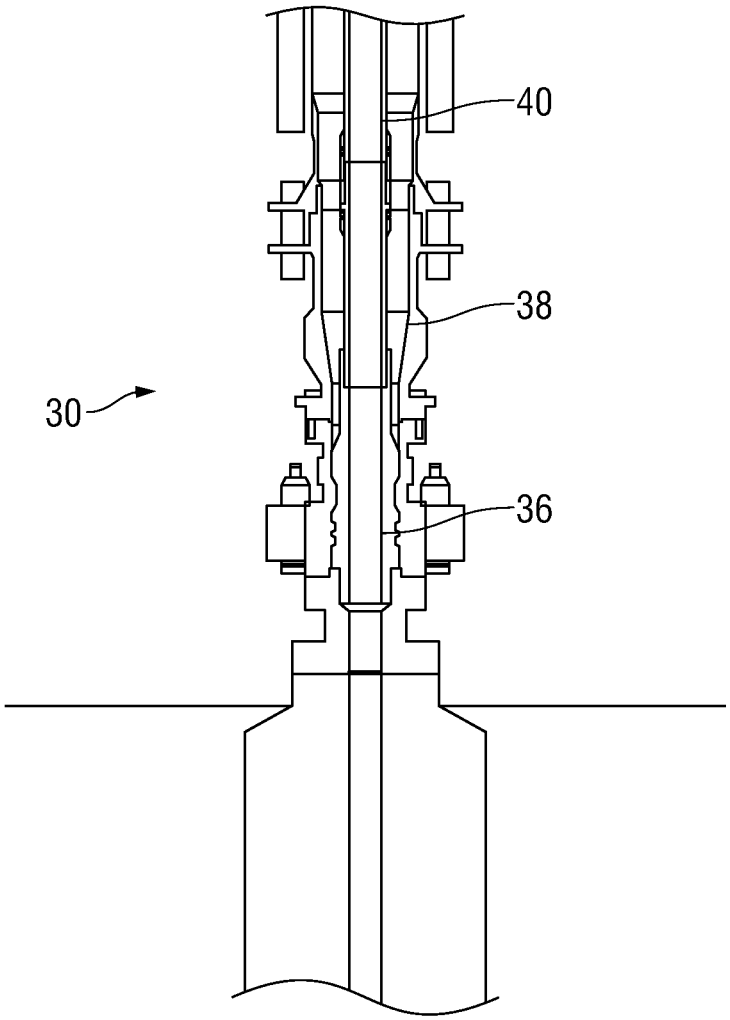
FIG. 2 is a partial cross-section of an embodiment of the riser system.

As shown in FIG. 2, the HPI 30 may include an HPI mandrel 36. The HPI mandrel 36 interfaces with and locks into the HP-LP connector 20 at the top of the SSP assembly 16 shown in FIG. 1. The HPI 30 also includes a HP mandrel crossover 38. The HP mandrel crossover 38 provides a crossover between the HPI mandrel 36 and the HPI joints 40. The HP mandrel crossover 38 also acts as saver sub for the HPI mandrel 36. The HPI joints 40 are preferably a 7" bore HP conduit, to make up necessary overall length. The HPI 30 may also include a HPI surface joint 42 shown in FIG. 7. The HPI surface joint 42 is typically the final section of a HP conduit. Additional items, such as HP centralizers 44 can provide controlled centralization of the HPI joints within the riser system 10.

Figure 3:
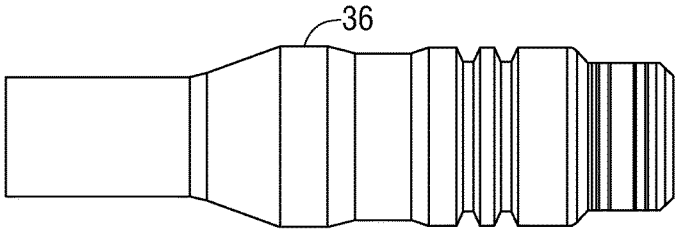
FIG. 3 is a partial, side view of an embodiment of a mandrel.

Referring, to FIG. 3, an HPI mandrel 36 is shown. The HPI mandrel 36 may be installed on the lower end of the system 10 and can latch and seal in the HP-LP connector 20 to extend the system 10 from the HP-LP connector 20 and SSP 16 to the CT or WL intervention frame 34 above the rotary table. In a preferred embodiment, standard configuration is 7⅜" bore and 10,000 psi maximum working pressure.

Figure 4:
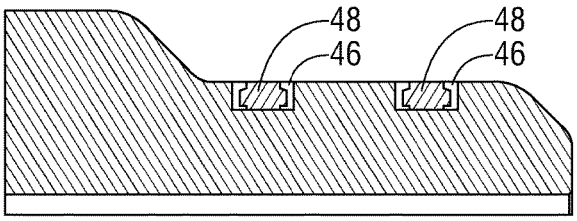
FIG. 4 is a partial, cross-section side view of an embodiment of the mandrel.

The HPI mandrel 36 typically has a robust external profile which interfaces with the internal bore of the HP-LP connector assembly 20. As shown in FIG. 4, twin locking grooves 46 interface with the locking dogs of the connector 20 while a smaller outer diameter nose positioned below the land out shoulder houses the two main elastomeric seals 48. An upper and lower locating diameter on the outer profile of the HPI mandrel 36 guide it into the bore of a connector 20 and provide close vertical alignment of the HPI mandrel 36 prior to the nose entering the seal bore. In a preferred embodiment, the profile of the nose and the position of the two main seals 48 may be such that the seals 48 cannot make contact with the inner surfaces of the system during installation. The main seals 48 may be elastomeric with dual backup rings. The profile of the backup rings may be such that they are retained in position by the elastomeric seals 48. In a preferred embodiment, the upper end of the HPI mandrel 36 may be configured with a suitable box connection to interface with the HP mandrel crossover 38.

Figure 5:
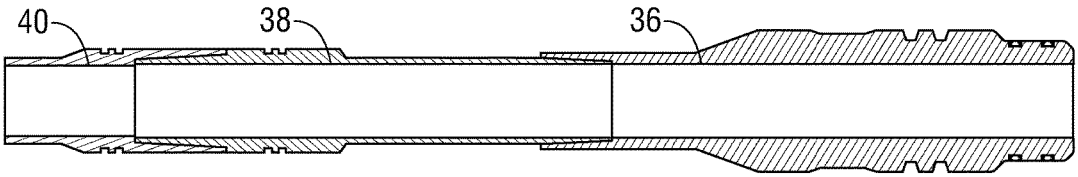
FIG. 5 is a partial, cross-section side view of an embodiment of the crossover mandrel.

The mandrel crossover 38 is shown in more detail in FIG. 5. The HP mandrel crossover 38 forms the transition from the HP mandrel 36 to the HPI riser joints 40. The HP mandrel crossover 38 and acts a saver sub for the mandrel box connection if present.

Figure 6:
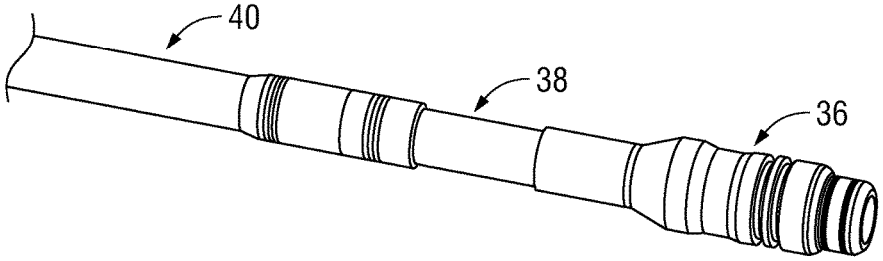
FIG. 6 is a partial, perspective view of an embodiment of a HPI joint.
Figure 7:
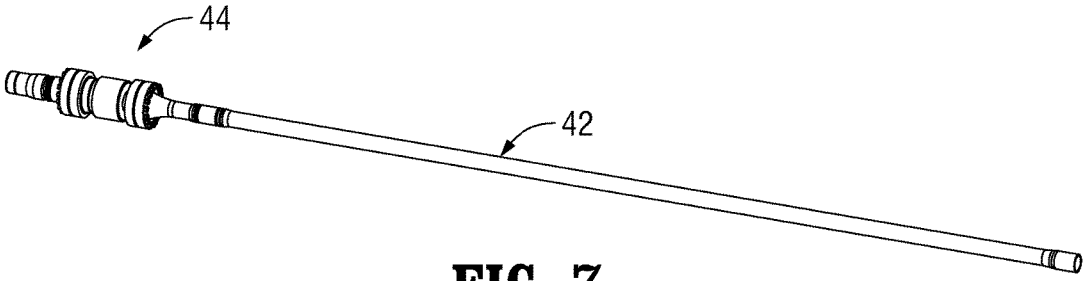
FIG. 7 is a partial, perspective view of an embodiment of a HPI surface joint.

The HPI joints 40 shown in FIG. 6 make up the length of HP conduit from the mandrel crossover 38 to the HPI surface joint 42 shown in FIG. 7. The lengths of the HPI joints 40 are selected to reduce the number of connections required while maintaining suitable lengths for handling on deck. In a preferred embodiment, it is expected that the overall HPI mandrel 36/HPI crossover 38/HPI joints 40 will be stored on the rig in two separate lengths. The mid position connection will be made up at rig up on drill floor. The joints will be deployed to the drill center by rig systems and hung off in power slips during rig up.

In the preferred embodiment, the overall length of the lower insert (HPI mandrel 36, HPI crossover 38, and HPI riser joints 40) is 30.7 m. During rig up of the system 10, there may be a stick up above the rig floor of approximately 1 m; this geometry has the HPI mandrel 36 standing 8.2 m off the latch 56 which both ensures that there will be no contact between the HPI mandrel 36 and latch 56 due to vessel heave or similar situation. This also allows for lowering of the final made up system 10 to a position below the flex joint 26 far enough so that it does not heave through riser flex joint during operations such that only slick pipe of a HPI surface joint 42 will heave through.

Once the complete system 10 is hung off in power slips at a rotary, the system 10 may be lowered into the insert and itself hung off a small c-plate. Toolstrings of up to 30.7 m can be inserted into the lower insert during rig up and they are completely protected from any motion by being within the insert. Longer toolstrings can also be inserted, but these may extend out of the bottom of the insert. Very long toolstrings can be positioned through the lower insert and through into the SSP 16 and 7" riser system below but these should be spaced out to have slick sections at the latch 56 location so as to eliminate risk of damage as they heave relative to the latch 56.

The HPI surface joint 42 may be the top joint in the system 10. An optional centralizer 44 is shown also. A preferred embodiment of the system 10 provides that optimum operability is achieved with the HPI string centralized within the inner diameter of a slip joint inner barrel. It can be deployed from a storage position on deck to above stick up at rig floor and underneath the frame 34 which is elevated up a rig tower. First the top connection to frame 34 is made up, then wire or coil is then lowered down the HPI surface joint 42 and made up to the toolstring landed out on a stickup. Finally, a riser connection is made between the HPI surface joint 42 and a stick up.

The surface joint 42 is sized to ensure that when landed and locked in the HP-LP connector 20 there is sufficient clearance under the interventions of frame 34 to prevent them contacting the rig floor under all anticipated environmental conditions specified for intervention operations. The joint length also ensures that the last joint made up passes down past the flex joint 26 to far enough to prevent it being pulled back up into the flex joint 26 as the vessel heaves during intervention operations. Overall HPI surface joint 42 length is preferably 16.9 m, in one particular embodiment.

A 10k HP swivel and a HP connector mandrel 52 may be installed on the upper end of the HP surface joint 42. The HP connector mandrel 52 interfaces with the mating connector on the bottom of the CT or WL intervention frame 34. The swivel allows the HPI surface joint 42 to rotate relative to the lower section hung off in the slips during makeup of the last connection. The swivel also releases the complete high pressure insert from torsion as the vessel heading varies. The riser itself may be free to rotate due to the riser tension ring swivel function.

The following sequence illustrates one possible rig up procedure for the HPI on the on a preferred embodiment. HPI joints 40 are stored on a setback drum. The lower HPI joint 40 is deployed from setback to drill center, passing joint to the slip elevators. The HP mandrel 36 passes the through the rotary. Power slips are installed through the rotary. The power slips are installed on the HPI joint 40. The mid HPI joints 40 are picked up and made to the lower joint using casing tubing tongs. A small c plate can be lowered onto the toolstring on top of the insert. A CT frame 34 is placed over the stickup. The frame 34 is engaged with elevators and guidance trolleys such that the frame 34 can be lifted to a position suitable to allow for the installation of the HPI surface joint 42. The HPI surface joint 42 from the setback with piperackers and moved to the drill center under the frame 34. The connector 20 is engaged with the frame 34 and latch 56 is activated. The frame 34 is lowered and latching pins on the latch 56 are engaged. The surface HPI joint 42 is lowered by the frame 34 while the frame 34 remains latched to the tower. The final insert joint is connected to a swivel to take out the rotation of the surface joint 42. The power slips are released and removed from the rotary. An active heave compensator may be engaged and the system 10 is lowered until the HPI mandrel 36 engages with the HP-LP connector 20 at the SSP 16. Once latched, the draw works may be reconfigured to allow for a small pull on the system 10 or to commence CT operations downhole.

As discussed above, for low pressure operations, the existing high pressure riser system is rigged up with the low pressure telescoping joint connecting the high pressure riser system to the vessel. The vessel is now connected to the subsea tree. The vessel motions are restricted as a function of dynamic positioning, however the vessel still experiences heave motions. The heave motions are absorbed by the low pressure telescoping joint but effectively the riser length, and therefore volume, is constantly changing as a result of vessel motion. The telescoping flow tube is inserted and landed out within the base of the telescoping joint. The telescoping flow tube is landed out at the drill floor level and is now compensating in parallel with the vessel. The volume change as a function of the telescoping flow tube is facilitated by holes within the cavity and so no volume change occurs as a result of vessel motion. Constant volume is key for well control in these relatively slimhole drilling operations. The reduced bore afforded by the telescoping flow tube promotes cuttings velocity and maintains well cleanout.

Figure 8:
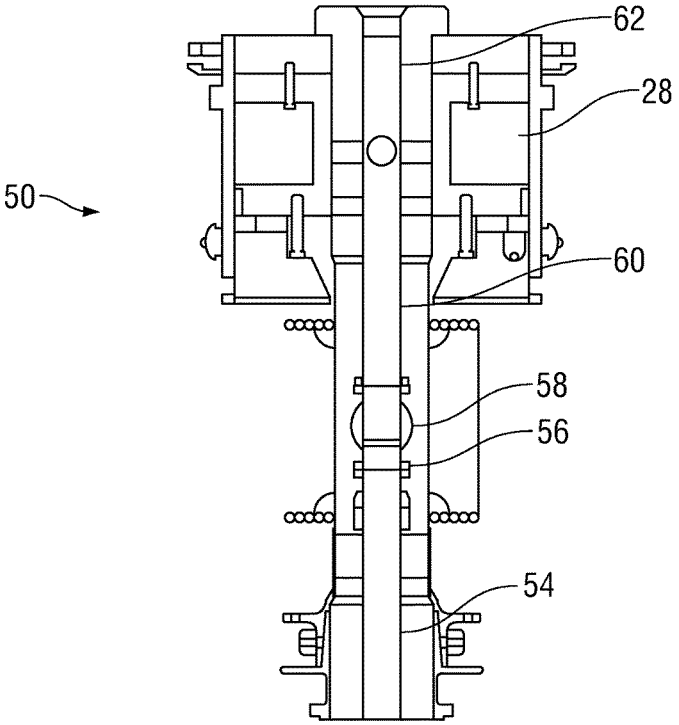
FIG. 8 is a partial, cross-section side view of an embodiment of the riser system.
Figure 9:
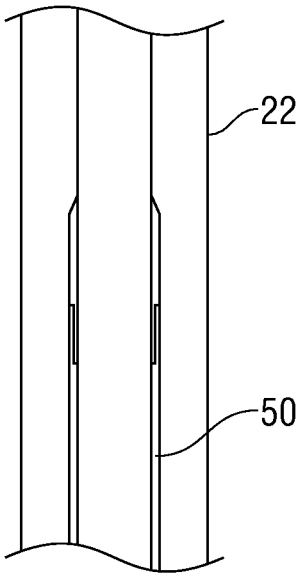
FIG. 9 is a partial, cross-section side view of an embodiment of the riser system.
Figure 10:
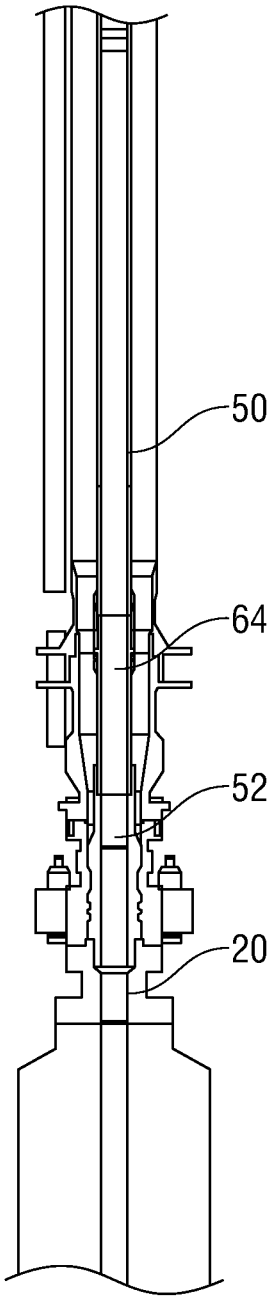
FIG. 10 is a partial, cross-section side view of an embodiment of the riser system.

As shown in FIGS. 8-10, the TFT system 50 that may be installed inside the upper low pressure section of a riser during TTRD operations to maintain a suitably small annulus area around the drill pipe for effective cuttings transportation up the entire length of the riser to the exit point at a diverter 28. The TFT system 50 may be installed within the LP slip joint 26 and is therefore not required to be pressure retaining. Its primary function is to maintain a suitable bore for the drilling returns while ensuring cuttings cannot drop out and accumulate inside the LP slip joint 26.

The TFT system 50 may include and insert mandrel 52 and spacer assembly 64 shown in FIG. 10. The mandrel 52 interfaces with and locks into the HP-LP connector assembly 20 at the SSP 16 top and continues the bore up the TFT system 50. The TFT system 50 may also include a TFT LP telescopic conduit 54 shown in FIG. 8. The telescopic conduit 54 may be non-sealing in nature. The TFT system 50 may also include TFT latches 56. The latches 56 enables the TFT system 50 to be locked closed for handling operations. The TFT system 50 may also include a TFT LP flex joint 58. The TFT LP flex joint 58 is an internal flex joint that is positioned with in a main riser flex joint. The TFT system 50 may also include a TFT main housing 60. The TFT main housing 60 lands off and latches 56 inside a diverter insert 28. The TFT main housing 60 directs the returns flows into the rig mud return system. The TFT system 50 may also include a rotating control device ("RCD") 62. The RCD 62 can seal around drill pipe and may be capable of preventing returns egress to the rig floor.

The lower end of the TFT system 50 may be anchored by means of the same HP mandrel 36, as discussed above, while the upper end is anchored inside the diverter 28. At the upper end of the TFT system 50, there may be the TFT main housing 60 that interfaces with the diverter 28 with a seal above and below any exit ports. This serves as a means to land out and lock the upper half of the TFT system 50. In the preferred embodiment, the main housing 60 is configured with 4 large diameter equispaced holes to provide a large exit area to ensure that the flow can easily flow into a return line. With the goal being to maintain fluid velocity, there is always the potential for the flow (or a proportion of the flow) to carry on up and out of the top of the main housing 60 so the RCD 62 is latched in the top to give positive control of the return flow. The RCD 62 can be latched in separately at any point during the running of the drill string. A vent hole may be included in the main housing 60. This vent hole serves to ensure that full control of the fluid type, pressure and level can be maintained at all times.

The main housing 60 may be locked into the diverter 28 by means of the existing twin internal grooves in the diverter 28 used for its installation in the preferred embodiment. This lock function may be controlled by control lines exiting from the top of the TFT main housing 60.

A flex joint 58 may be incorporated to take up the flex at this point and protect the TFT system 50 from being subjected to cyclic bending loads. The flex joint 58 may not need to carry high tensile load nor any significant pressure so it may not be a demanding application. Those skilled in the art will recognize that detail design will determine if a ball joint configuration or a flexible rubber type element would be the best construction type.

Below the TFT flex joint 58 may be the TFT Latch 56. This latches the TFT system 50 in the closed position for transportation, handling, and during key points in the installation and retrieval sequence. The control lines for this latch 56 pass up the outside of the TFT system 50 to exit above the top face of the TFT main housing 60. The TFT system 50 itself may include outer barrel and inner barrel with a seal/glide pad assembly between the two in a preferred embodiment. As the TFT system 50 sits, neither the top or bottom seal stacks may need to be fully sealing or pressure retaining and can therefore be designed with the primary goal of debris exclusion and reliable damage free movement during operations. The TFT system 50 may be configured with the same stroke capability. A series of holes at the top of the outer barrel allow easy unobstructed fluid transfer into and out of the TFT system 50. The top of the TFT outer barrel may be configured with a latch profile which interfaces with the latch positioned below the TFT flex joint 58.

The bottom end of the TFT system 50 may be connected to a short spacer assembly 64 which has the mandrel 52 on the bottom to interface with the HP-LP connector 20. This spacer 64 may serve to make up the distance from the end of the HP-LP connector 20.

The internal bore of the TFT assembly 50 may be 7 1/16" minimum. In a preferred embodiment, this bore may be increased to achieve the optimum balance between a bore that is small enough to maintain a good return flow velocity and have sufficient bore size to accommodate the running of bottom hole assembly and other downhole assemblies.

An example of the rig up sequence of the TFT for TTRD operations is as follows. The mandrel 52 and spacer 64 are moved to the rotary. The TFT assembly 50 is installed up to the main housing 60 onto the top of the mandrel 52. With the TFT system 50 still locked closed, land and lock the main housing 60 into the diverter insert 28. Unlatch the deployment tool from the top engagement point in the TFT main housing 60 and run down and engage with a similar profile incorporated into the mandrel 52 at the bottom. Unlatch the TFT latch 56 by means of the line passing up through the top. Run down carrying/pulling the lower end of the TFT system 50 downwards and land out in the HP-LP connector 20. Engage the HP-LP connector 20 to the TFT mandrel 52. Unlatch the deployment tool and recover. The TFT system 50 is now in place. Run bottom hole assembly and drill pipe to the required depth. Install RCD 62 at required point and run through rotary to latch with into the top of the TFT main housing 60. The removal sequence is the reverse of the deployment sequence.

While the invention has been described with reference to one or more particular embodiments, those skilled in the art will recognize that many changes may be made thereto without departing from the spirit and scope of the description. Each of these embodiments and obvious variations thereof is contemplated as falling within the spirit and scope of the claimed invention, which is set forth in the following claims.

What is claimed is:

1. A riser system comprising:

a high pressure bore submerged subsea stack;

a high pressure bore submerged surface package of valves;

a high pressure bore open water riser joint connected to the high pressure bore submerged subsea stack and the high pressure bore submerged surface package of valves; and a crossover assembly with a high pressure-low pressure connector, wherein the crossover assembly is connected to the high pressure bore submerged surface package of valves;

a low pressure slip joint connected to the crossover assembly;

a tension ring connected to the low pressure slip joint;

a flex joint;

a diverter connected to the flex joint;

a high pressure insert; and a telescoping flow tube wherein the telescoping flow tube further comprises a telescoping flow tube low pressure flex joint;

wherein the high pressure insert and the telescoping flow tube are capable of being lowered into the low pressure slip joint and engaging the high pressure-low pressure connector.

2. The riser system of claim 1 further comprising a frame suspended above a rig floor of the riser system on a draw works.

3. The riser system of claim 2 further comprising a coiled tubing stack or a wireline stack connected to the frame and the high pressure insert.

4. The riser system of claim 1, wherein the high pressure insert further comprises-a mandrel connected to high pressure-low pressure connector.

5. The riser system of claim 4, wherein the high pressure insert further comprises a high pressure mandrel crossover.

6. The riser system of claim 4 wherein the mandrel comprises at least one seal.

7. The riser system of claim 4 wherein the mandrel comprises at least one elastomeric seal.

8. The riser system of claim 4 wherein the telescoping flow tube further comprises a latch.

9. The riser system of claim 1, where the telescoping flow tube further comprises-a telescoping flow tube low pressure telescoping conduit.

10. The riser system of claim 1, wherein the telescoping flow tube further comprises at least one telescoping flow tube latch.

11. The riser system of claim 1 wherein the telescoping flow tube further comprises a telescoping flow tube main housing.

12. The riser system of claim 11 further comprising a rotating control device in the telescoping flow tube main housing.

13. A method of installing a riser system that comprises the steps of:

(a) connecting a high pressure bore submerged surface package of valves to a high pressure bore open water riser joint;

(b) connecting the high pressure open water riser joint to a high pressure bore submerged subsea stack;

(c) connecting the high pressure bore submerged surface package of valves to a crossover assembly with a high pressure-low pressure connector;

(d) connecting a low pressure slip joint to the crossover assembly; and (e) connecting a telescoping flow tube through the low pressure slip joint and engaging the high pressure-low pressure connector, wherein the telescoping flow tube further comprises a telescoping flow tube low pressure flex joint.

14. The method of claim 13 that further comprises the steps of:

(f) disconnecting the telescoping flow tube; and (g) connecting a high pressure insert through the low pressure slip joint and engaging the high pressure-low pressure connector.

* * * * *